US009643036B2

(12) United States Patent
Burkett

(10) Patent No.: US 9,643,036 B2
(45) Date of Patent: May 9, 2017

(54) FIRE AND SMOKE CONTAINMENT AND EXTINGUISHING APPARATUS

(71) Applicant: Brian D. Burkett, Uniontown, OH (US)

(72) Inventor: Brian D. Burkett, Uniontown, OH (US)

( * ) Notice: Subject to any disclaimer, the term of this patent is extended or adjusted under 35 U.S.C. 154(b) by 0 days.

(21) Appl. No.: 14/876,454

(22) Filed: Oct. 6, 2015

(65) Prior Publication Data

US 2016/0096049 A1 Apr. 7, 2016

Related U.S. Application Data

(63) Continuation of application No. 13/840,075, filed on Mar. 15, 2013, now Pat. No. 9,180,324.

(Continued)

(51) Int. Cl.

| | |
|---|---|
| ***A62C 8/00*** | (2006.01) |
| ***A62C 3/00*** | (2006.01) |
| ***A62C 2/06*** | (2006.01) |
| ***A62C 3/16*** | (2006.01) |
| ***A62C 8/06*** | (2006.01) |
| ***A62C 35/02*** | (2006.01) |
| ***A62C 99/00*** | (2010.01) |
| *A62C 3/08* | (2006.01) |

(52) U.S. Cl.

CPC ..... *A62C 3/00* (2013.01); *A62C 2/06* (2013.01); *A62C 3/16* (2013.01); *A62C 8/00* (2013.01); *A62C 8/06* (2013.01); *A62C 35/02* (2013.01); *A62C 99/0009* (2013.01); *A62C 3/002* (2013.01); *A62C 3/08* (2013.01)

(58) Field of Classification Search

CPC .... A62C 2/06; A62C 2/08; A62C 2/10; A62C 2/242; A62C 2/243; A62C 8/06; A62C 13/00; A62C 37/38; A62C 3/16

USPC ..... 169/43–45, 48–50, 58–60

See application file for complete search history.

(56) References Cited

U.S. PATENT DOCUMENTS

| | | | |
|---|---|---|---|
| 4,250,967 | A | 2/1981 | Horwincki et al. |
| 4,411,318 | A | 10/1983 | Zeischegg et al. |

(Continued)

FOREIGN PATENT DOCUMENTS

| | | |
|---|---|---|
| GB | 2349084 A | 10/2000 |
| WO | WO-2014/116354 | 7/2014 |

OTHER PUBLICATIONS

In the U.S. Patent and Trademark Office, Notice of Allowance in re: U.S. Appl. No. 13/840,075, filed Sep. 24, 2015, 5 pages.

(Continued)

*Primary Examiner* — Davis Hwu

(74) *Attorney, Agent, or Firm* — Porzio, Bromberg & Newman P.C.

(57) ABSTRACT

Systems and methods for fire and smoke containment and extinguishing are described. Systems may include a fire and smoke containment and extinguishing apparatus including an open recess with one or more walls. The open recess may substantially prevent passage of fire, smoke and fumes. The apparatus may also include one or more seals for closing the open recess, and a fire extinguishing system. Methods for fire and smoke containment and extinguishment may include providing a fire and smoke containment and extinguishing system; inserting an item into the recess of the apparatus; closing the recess; and deploying the fire extinguishing system.

14 Claims, 11 Drawing Sheets

Related U.S. Application Data

(60) Provisional application No. 61/756,776, filed on Jan. 25, 2013.

(56) References Cited

U.S. PATENT DOCUMENTS

| | | | | |
|---|---|---|---|---|
| 4,433,733 | A | 2/1984 | Cunningham | |
| 4,580,638 | A | 4/1986 | Jones et al. | |
| 5,056,603 | A | 10/1991 | Parkinson | |
| 5,228,547 | A | 7/1993 | Yoo | |
| 8,146,674 | B2 * | 4/2012 | Lee | G21F 7/00 169/11 |
| 9,180,324 | B2 * | 11/2015 | Burkett | A62C 2/06 |
| 2003/0066660 | A1 | 4/2003 | Horwell et al. | |
| 2004/0262018 | A1 | 12/2004 | Roussin | |
| 2005/0126794 | A1 * | 6/2005 | Palmer | A62C 3/0214 169/16 |
| 2005/0150664 | A1 | 7/2005 | Miller et al. | |
| 2005/0252177 | A1 * | 11/2005 | Ishikawa | B01D 39/2093 55/282.3 |
| 2009/0014188 | A1 | 1/2009 | Hesch et al. | |
| 2012/0211246 | A1 | 8/2012 | Zlatintsis | |
| 2014/0000196 | A1 * | 1/2014 | Daniels | E06B 3/822 52/232 |
| 2014/0209331 | A1 | 7/2014 | Burkett | |
| 2014/0209332 | A1 | 7/2014 | Burkett | |

OTHER PUBLICATIONS

In the U.S. Patent and Trademark Office, Final Office Action in re: U.S. Appl. No. 13/840,075, filed Aug. 31, 2015, 4 pages.
In the U.S. Patent and Trademark Office, Office Action in re: U.S. Appl. No. 13/840,075, filed Feb. 18, 2015, 6 pages.
In the U.S. Patent and Trademark Office, Office Action in re: U.S. Appl. No. 14/097,287, filed Apr. 13, 2015, 7 pages.
In the U.S. Patent and Trademark Office, Final Office Action in re: U.S. Appl. No. 14/097,287, filed Jun. 30, 2014, 9 pages.
In the U.S. Patent and Trademark Office, Office Action in re: U.S. Appl. No. 14/097,287, filed Mar. 21, 2014, 7 pages.
In the U.S. Patent and Trademark Office, Requirement for Restriction/Election in re: U.S. Appl. No. 14/097,287, dated Feb. 20, 2014, 6 pages.
International Search Report and Written Opinion for related International Application No. PCT/US2013/073268, mailed Apr. 17, 2014.

* cited by examiner

FIRE AND SMOKE CONTAINMENT AND EXTINGUISHING APPARATUS

CROSS REFERENCE TO RELATED APPLICATIONS

This application claims priority to U.S. patent application Ser. No. 13/840,075, filed Mar. 15, 2013, which claims priority to U.S. Provisional Patent Application No. 61/756,776, filed Jan. 25, 2013; the contents of which are incorporated by reference herein in their entirety.

FIELD OF THE INVENTION

The present invention relates to systems and methods for fire and smoke control, and, more specifically, to systems and methods for rapid containment and extinguishing of fire and smoke.

BACKGROUND OF THE INVENTION

In the past, the Federal Aviation Administration supported the use of a thermal type blanket or bag to contain a personal electronic device (PED) fires. After further investigation, however, the FAA discouraged their use due to the inability of this type of system to extinguish and cool the cells of the batteries that power the (PED) and are the main cause of fires experienced with these types of devices. The use of currently available thermal blankets or bags has limited effects on reducing the amount smoke and toxic fumes experienced during a PED=type battery fire. There is an extreme danger that exists for fires which occur in confined spaces, especially those present in aviation environments. The lack of effective and rapid containment and extinguishing methods in these types of environments is a critical issue.

Needs exist for improved systems and methods for improved containment and extinguishing of fire and smoke. Needs also exist for a shipping container that can provide a method for safely transporting any item which may pose a potential fire risk.

SUMMARY OF THE INVENTION

Embodiments of the present invention solve many of the problems and/or overcome many of the drawbacks and disadvantages of the prior art by providing systems and methods for containment and extinguishing of fire and smoke.

Embodiments of the present invention may include systems and methods for containment and/or extinguishing fire, smoke or access to materials that might induce fire or smoke. Systems may include a fire and smoke containment and extinguishing apparatus including an open recess with one or more walls. The open recess may substantially prevent passage of fire, smoke and fumes. The apparatus may also include one or more seals for closing the open recess, and a fire extinguishing system. A flap may cover the one or more seals. Methods for fire and smoke containment and extinguishment may include providing a fire and smoke containment and extinguishing system; inserting an item into the recess of the apparatus; closing the recess; and deploying the fire extinguishing system.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE PREFERRED EMBODIMENTS

Figure 1A:
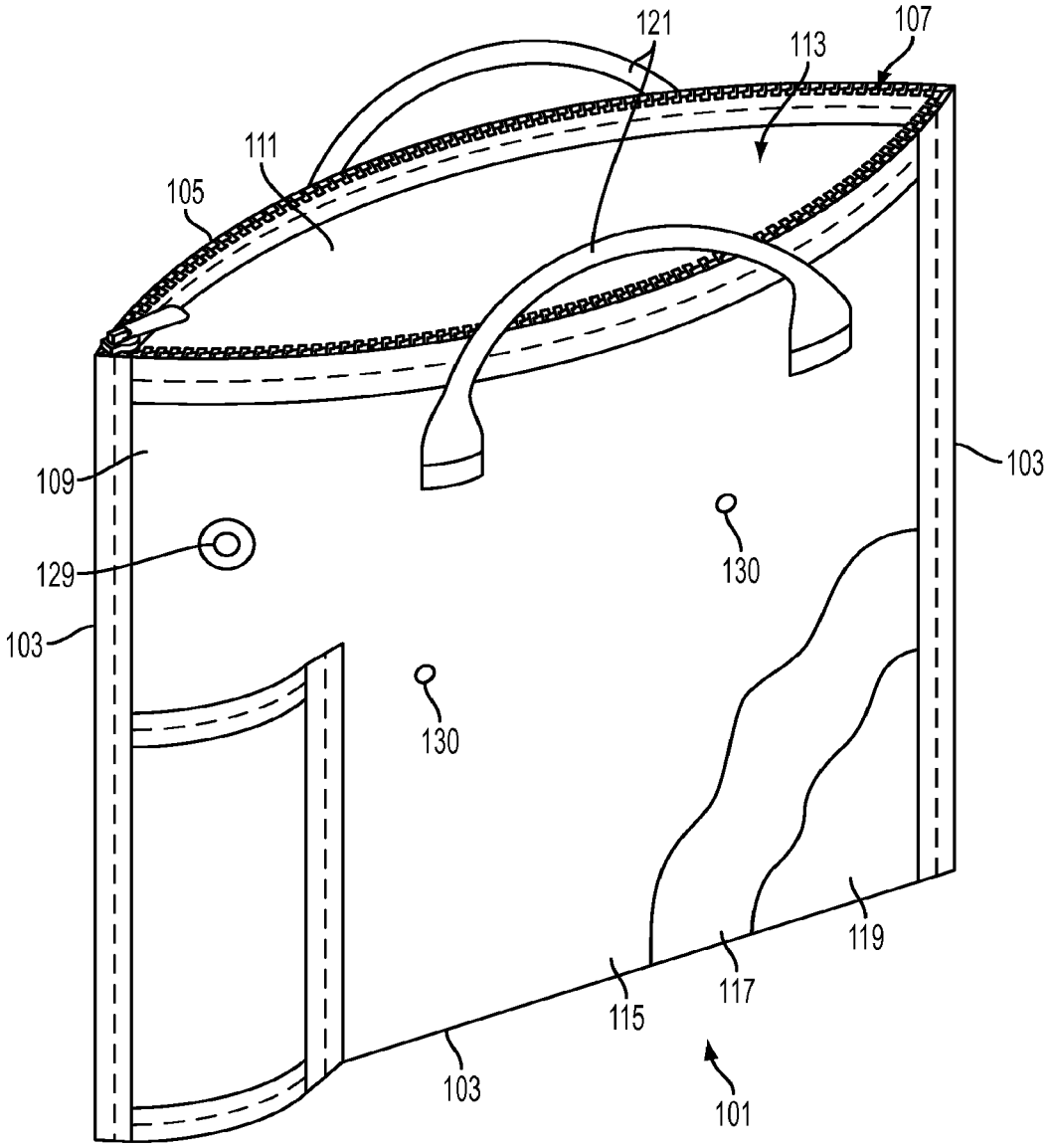
FIG. 1A is a perspective view of a fire and smoke containment and extinguishing envelope according to one embodiment.

Systems and methods are described for containment and extinguishing of fire and smoke. In certain embodiments described herein, a bag is used for illustrative purposes. It is understood that for most embodiments any other type of container may be used with similar results, such as a box, carton, crate, envelope, etc.

In certain embodiments, a Fire and Smoke Containment and Extinguishing Apparatus (FSCEA) may be a self-contained, sealable vessel, such as a bag, box, carton, crate, envelope, etc. An FSCEA according to the present invention may contain and/or extinguish an item that is in danger of catching on fire, or has already caught fire, provided that the item will fit within the boundaries of the FSCEA container.

An FSCEA of the present invention may be a container for containing fire and reducing smoke and toxic fumes emanating from an overheating and/or burning article including, but not limited to, an electronic device. The FSCEA may effectively contain fire, smoke and toxic fumes, and may extinguish and/or cool an item within the FSCEA. If the item is not fully extinguished, the FSCEA may be re-opened to apply other sources of extinguishing agents.

Embodiments of the present invention may be useful for aircraft industries, shipping or naval industries, businesses, personal use, etc. The systems and methods of the present invention may be used anywhere there is a desire to contain fire, smoke and/or fumes, reduce the amount of smoke and toxic fumes produced, and cool and/or potentially extinguish a fire within the container. In particular, embodiments of the present invention may be useful for fires originating from a battery, usually a lithium ion or nickel cadmium battery used in a personal electronic devices (e.g., laptop computers, tablet devices, e-readers, cell phones, smart phones, mp3 players, digital cameras, digital video cameras, curling irons, personal televisions, personal video game systems, etc.), which can fit into the confines of an FSCEA container. The FSCEA may confine minor explosions (flare-ups) that have been noted to occur during a battery thermal runaway. The FSCEA may come in various sizes, or may be adjustable to various sizes. Alternatively, the extinguishing capabilities of the FSCEA may be varied by changing the extinguishing agent and supply system to meet the needs of a specific application.

In certain situations, the FSCEA may be used primarily as a precautionary measure if the temperature of an electronic device or other item should rise above a level that is normally experienced. The FSCEA could also be used after an item has started the ignition process and there is not a more suitable alternative. A user of the FSCEA may put on provided fire resistant gloves or other suitable devices for moving the item, place the inside of the FSCEA, and close the FSCEA. The fire may be contained within the bag and the amount of smoke and toxic fumes may be greatly reduced. The FSCEA would then be placed, if available, into a safe area away from anything that may pose an ignition hazard. If the temperature inside the bag rises above a set temperature value at any location within the bag a sense line may rupture, preferably in a location proximate to the elevated temperature to apply an extinguishing agent or cooling agent proximate to an area of highest heat concentration within the FSCEA. If the temperature remains below a predetermined, set temperature the item preferably may be safely removed unharmed, and the extinguisher may not deploy.

The FSCEA may decrease the amount of oxygen available to feed the fire within the FSCEA. The FSCEA may be permanently sealed on all sides except one and may be include a fire resistant zipper or other closure on the remaining side, such as a top, of the FSCEA to completely seal it on all sides. The container may be sealed by use of a fire resistant zipper, straps, snaps, hook and loop closures, chemical closures, adhesives, etc., or a combination of different methods. The FSCEA may incorporate a layer of filtering material as part of its construction and a fire extinguisher attached directly to it. The extinguisher may be thermally, manually, or electronically discharged. A pair of fire resistant gloves may be included in the package to assist in picking up the device in question and placing it into the FSCEA and closing the FSCEA. Preferably, the closure mechanism not only seals the FSCEA but allows for reopening of the FSCEA if additional extinguishing medium is required or to remove the item after the temperature has normalized.

Figure 1B:
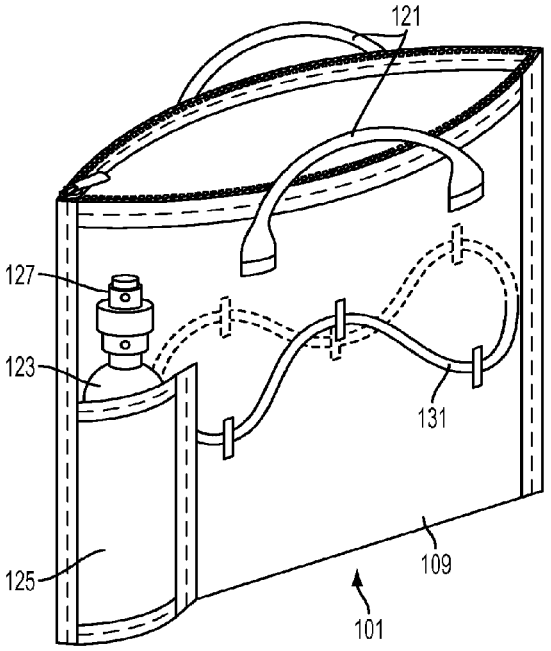
FIG. 1B is a perspective view with cutaway of a fire and smoke containment and extinguishing bag with extinguisher according to one embodiment.
Figure 1C:
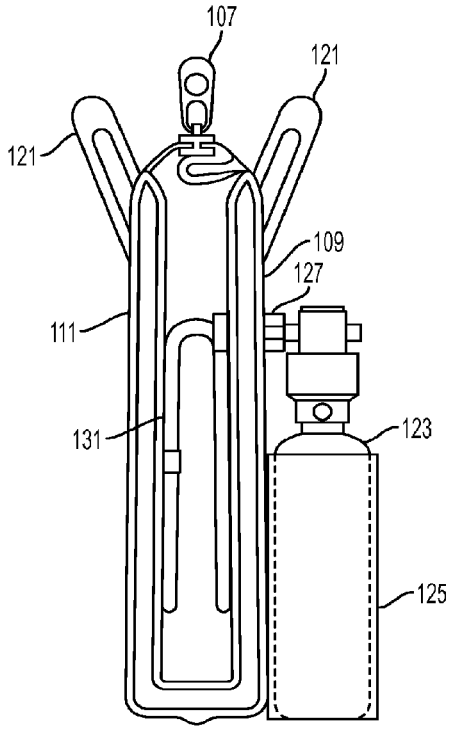
FIG. 1C is a side view with cutaway of a fire and smoke containment and extinguishing bag with extinguisher according to one embodiment.
Figure 1D:
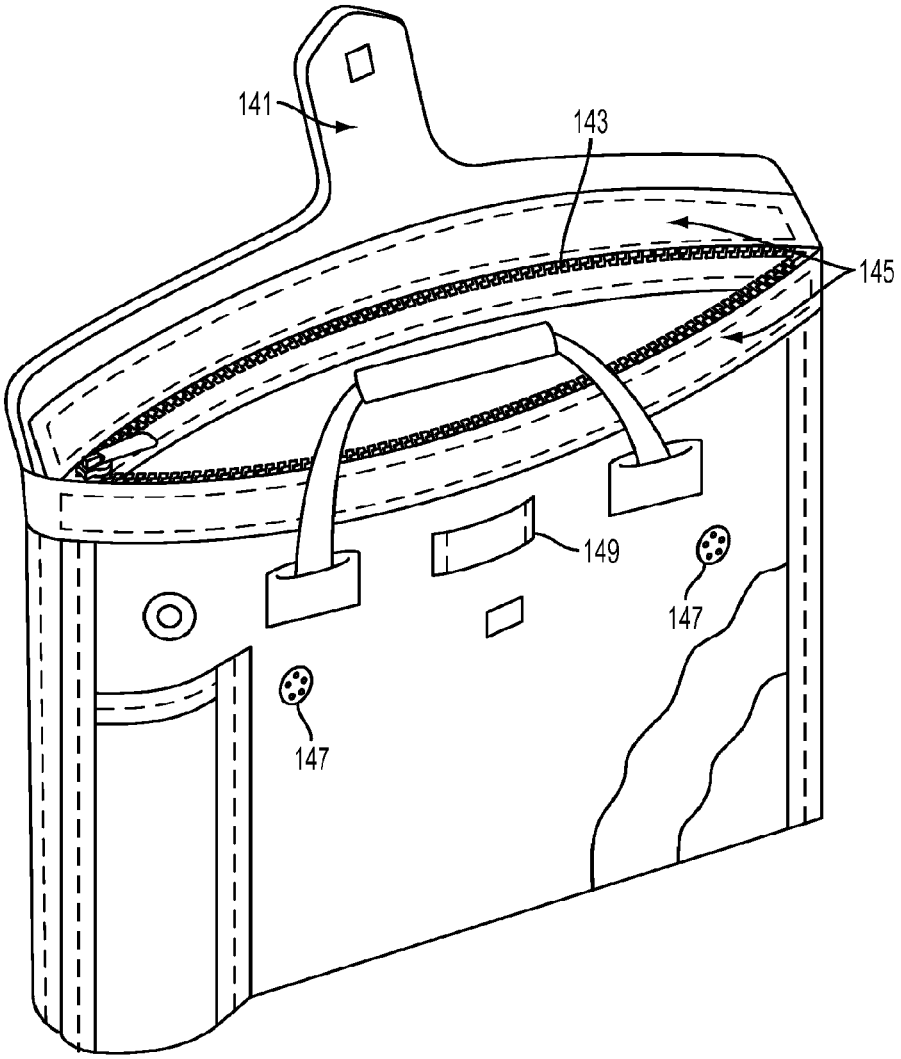
FIG. 1D is a perspective view of a fire and smoke containment and extinguishing bag with a flap according to one embodiment.
Figure 1E:
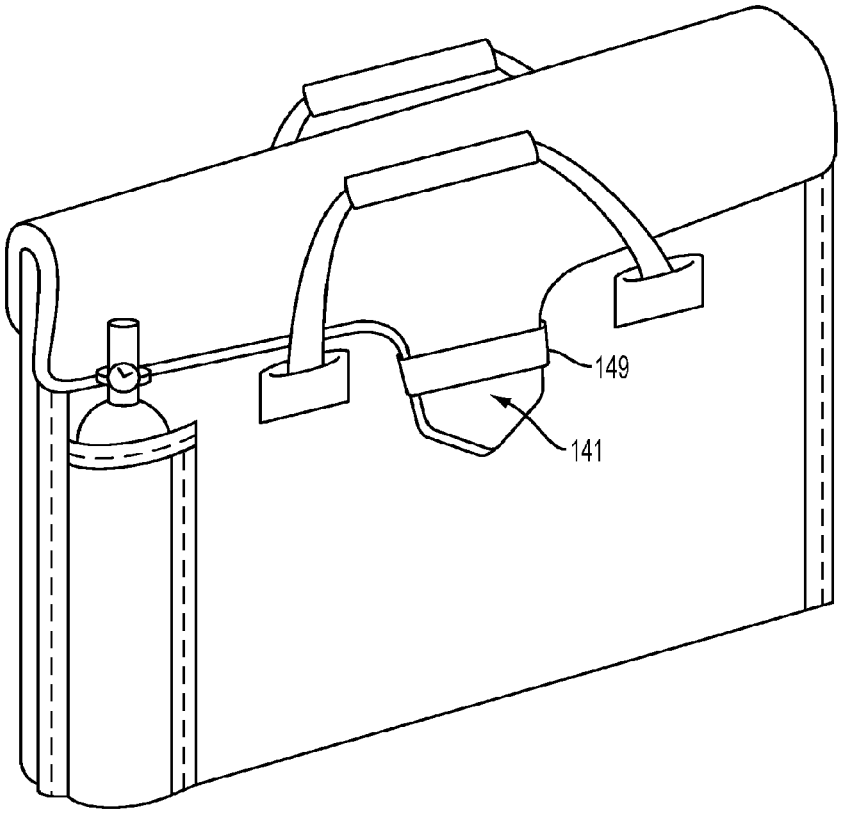
FIG. 1E is a perspective view of the fire and smoke containment and extinguishing bag of FIG. 1D with the flap closed according to one embodiment.
Figure 2:
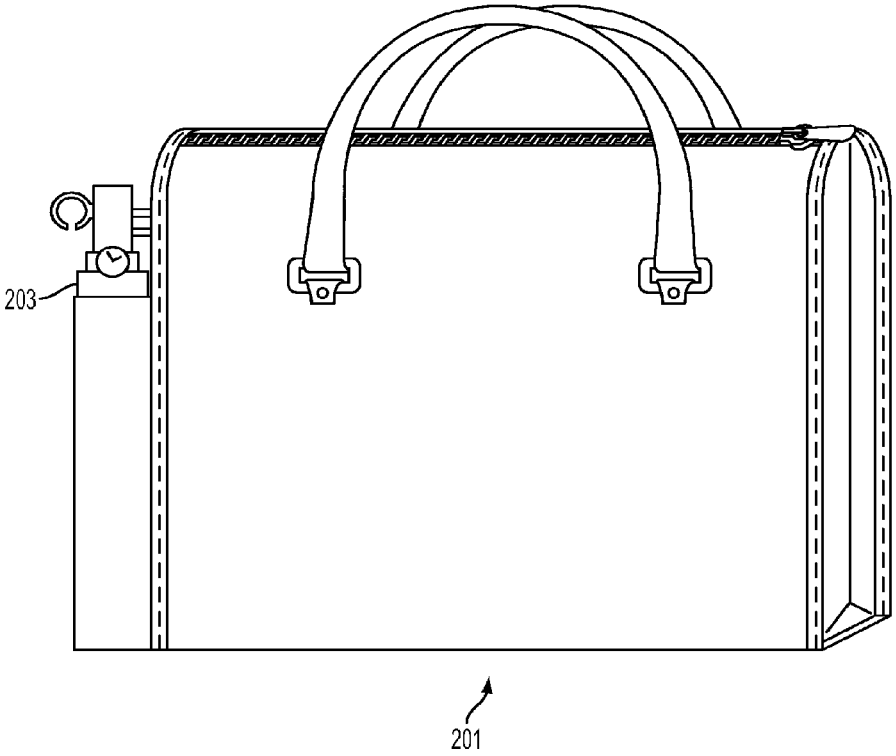
FIG. 2 is a perspective view of a fire and smoke containment and extinguishing bag according to one embodiment.
Figure 3:
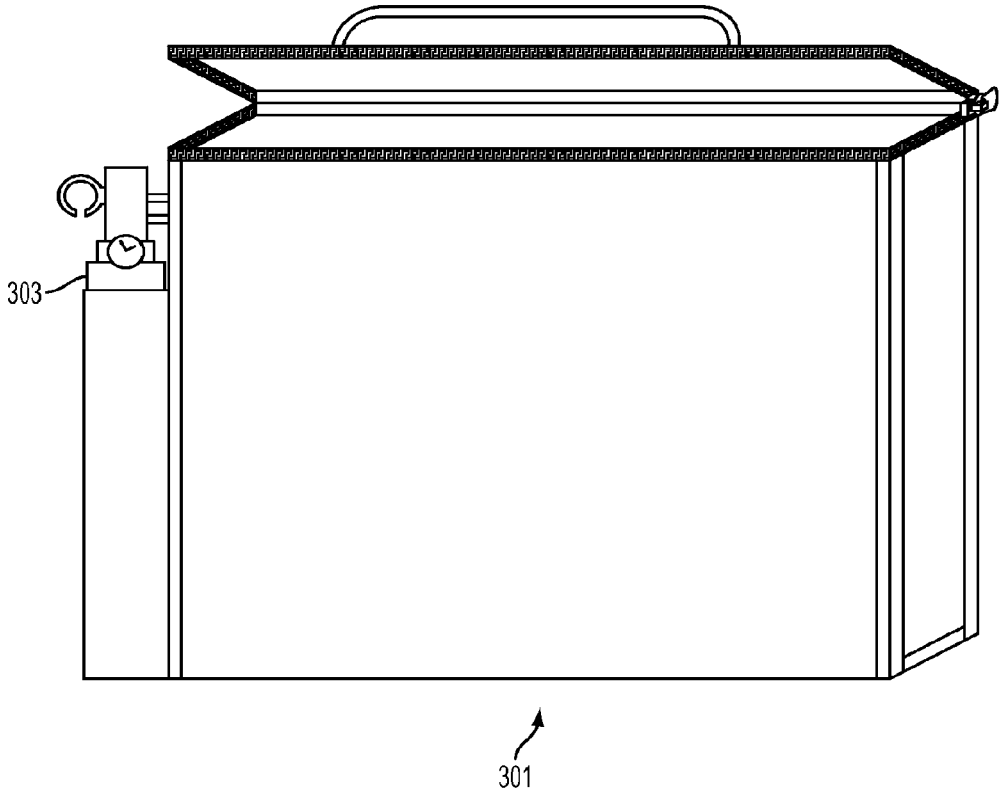
FIG. 3 is a perspective view of a fire and smoke containment and extinguishing crate or box according to one embodiment.

FIGS. 1-3 show embodiments of an FSCEA. As shown in FIG. 1, envelope 101 may include four edges. Three of the edges 103 may be permanently sealed. For example, a silicone rubber coated fiberglass cloth binding may be used on the edges 103. Other bindings, such as vermiculite coated and other coated fiberglass, vinyl laminated polyester, NOMEX, nylon, etc. may be used. A fourth edge 105 may be sealable and open able for insertion of an item (not shown). The fourth edge 105 may include an internal flap of vermiculite coated or other coated fiberglass cloth and/or a ceramic fiber material that may cover a closure 107 to assist in filtering smoke and fumes and add fire resistance. As seen in FIGS. 1D and 1E, an external flap 141 may be constructed in the same manner as the bag construction, and may include the same or different materials. The external flap 141 may be provided to protect and seal a zipper closure area 143. The flap 141 and/or other parts of the device can be constructed of an inner layer of vermiculite coated or other fiberglass coated material, ceramic fiber material, etc. for example heat rated to approximately 1000° F. or higher. A middle layer may be incorporated, and may be made from a ceramic fiber material, preferably rated at approximately 2300° F., and an outer layer may include silicone rubber coated fiberglass cloth, vinyl laminated polyester, NOMEX fabric, etc. preferably heat rated to approximately 500° F. or higher. The flap 141 may be held closed with the use of fire resistant closures 145, such as, but not limited to, hook and loop closures, adhesives, snaps, etc. A buckle 149 or other type of closure may also be included. As shown in FIG. 1A, a closure 107 may seal the fourth edge, such as a zipper, as shown in the figures. In certain embodiments, the zipper may be made of NOMEX, brass or other fire resistant materials. In certain embodiments, a first wall 108 and a second wall 111 may be coupled together to create an inner recess 113 for receiving the item. In various embodiments, such as a vessel or container may have one or more walls that may create an open recess. The first 109 and/or the second wall 111 may include one or more layers of material. In certain embodiments, an outer layer 115 may surround a middle layer 117, which in turn may surround an inner layer 119. In alternative embodiments, two layers of material are used. In other embodiments, only a single layer of material is used. Various numbers and materials may be used for various applications.

In certain embodiments, such as those shown in the Figures, the envelope 101 may be built of two to three separate layers of fire resistant material. An inner layer 119 may include a special fiberglass cloth, preferably heat rated to approximately 1000° F. or higher. A middle layer 117 may include a ceramic fiber material, preferably rated at approximately 2300° F. or higher, as well as being the filtering layer of material. An outer layer may include silicone rubber coated fiberglass cloth, preferably heat rated to approximately 500° F. or higher, vinyl laminated polyester, or NOMEX fabric may be used as a suitable replacement in some applications when desired. The material may be quilted together and sewn into a pocket shape using use flame resistant thread, such as KEVLAR or NOMEX thread, which is preferably rated to approximately 700° F.

One or more handles 121 may be included to maneuver the envelope, as shown in FIG. 1. The one or more handles 121 may be fire resistant. One or more fire resistant protective gloves (not shown) may be included to assist in placing the item in the envelope 101 and/or maneuvering the envelope 101. A silicone rubber coated fiberglass cloth, preferably rated at approximately 500° F. or higher may be used to create the one or more handles 121 and as edging for sealing of the envelope. Other materials, such as vermiculite coated fiberglass, vinyl laminated polyester, NOMEX, Nylon, etc. may be used.

One or more vents 130 and/or filters 147 may be incorporated into the structure to allow filtered air to release from the envelope 101.

FIG. 2 shows a perspective view of a bag 201 according to one embodiment with an external extinguisher 203. FIG. 3 shows a perspective view of a box or crate 301 according to one embodiment with an external extinguisher 303.

Figure 4:
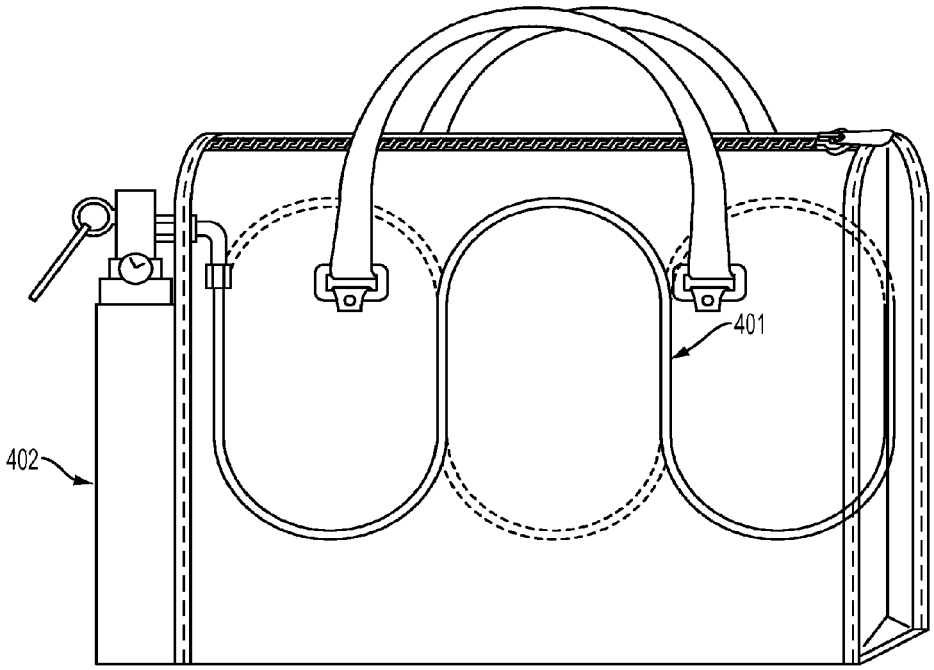
FIG. 4 is a perspective view of a fire and smoke containment and extinguishing bag with extinguisher according to one embodiment.

The FSCEA apparatus may include a fire extinguishing system, giving the FSCEA the capability to contain any heat, smoke or flames, extinguish a fire, and filter the resultant fumes or smoke created by a fire. Similar extinguishing systems are utilized in the boat and auto racing industries to extinguish engine fires and for driver protection. Several manufactures currently have extinguishing systems used for other applications which included heavy equipment and machine extinguishing systems, which can be modified to meet the needs of this system. An extinguisher 123, as shown in FIGS. 1B and 1C, may be located outside the envelope 101. In certain embodiments, the extinguisher 123 may be housed within a pocket 125 or other device to secure the extinguisher 123 to the envelope 101. It may also be secured to the device via brackets or straps made from fabric, metal, composite etc. An outlet 127 of the extinguisher 123 may feed into the inner recess 113 of the envelope 101. In certain embodiments, the outlet 127 may feed into the inner recess 113 through a port 129. The port may be a fire resistant grommet or washer with bulkhead type fittings or other similar passage between the outside of the bag 101 and the inner recess 113. In certain embodiments, the passage that can be opened and closed by the operator. A sense line 131, as shown in FIGS. 1B and 1C, or a fire or heat detection tubing 401, as shown in FIG. 4, may be constructed from a plastic, nylon, rubber, etc. The fire or heat detection tubing 401 may be a combined fire detector and delivery system. A fire extinguisher 402 may be in fluid communication with the detection tubing 401. The detection tubing 401 may detect the heat generated from a fire or fire threat and deploy by rupturing at a predetermined temperature value in proximity to where the temperature threshold is first exceeded. The sense line 131 or detection tubing 401 may be located within the inner recess 113 and may wind through the inner recess of 131 to provide for more accurate determinations of the location of highest concentration of temperature. Preferably, the sense line 131 may rupture in a location proximate to the highest temperature concentration to efficiently and effectively administer fire extinguishing material to the most relevant locations within the envelope 101.

The fire extinguishing agent utilized within the FSCEA system can vary based on the desired application. The extinguishing agents may include, but are not limited to: water, foams, gels, dry powder, wet chemical, gases, clean agents etc. Some examples of those agents are COLD-FIRE, HALON, HALOTRON, NOVEC 1230, FM-200, FE241, FE227, FE36, PURPLE K, FIRE-ADE2000, ANSUL R-102, etc.

Figure 7:
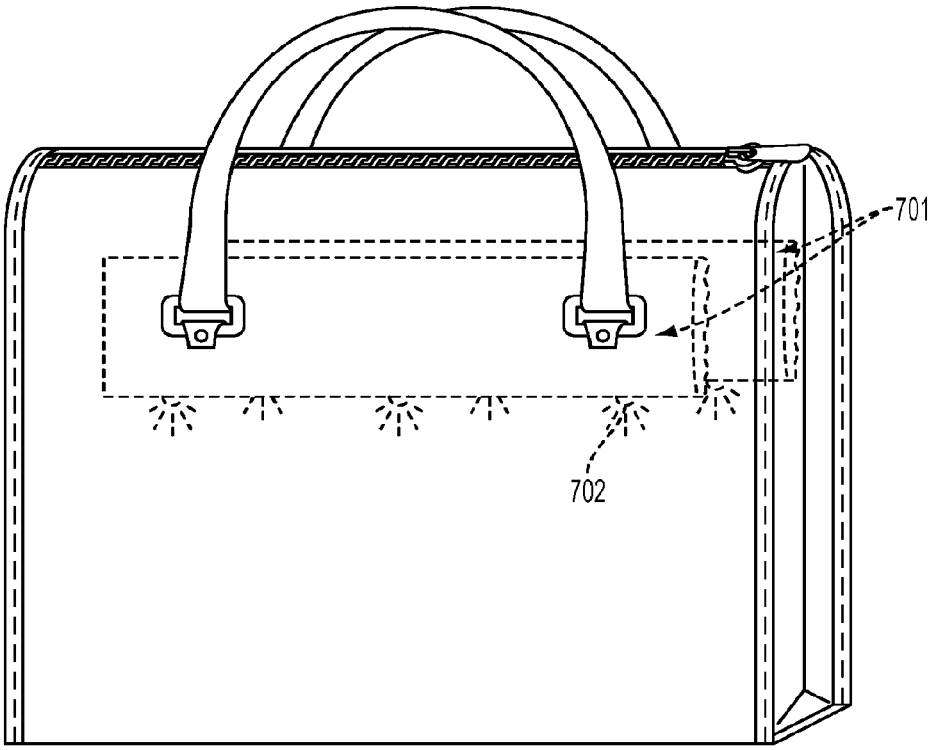
FIG. 7 is a perspective view of a fire and smoke containment and extinguishing bag with extinguisher according to one embodiment.

The FSCEA extinguishing system may include a self-contained fire extinguishing cylinder affixed to the side of the container. Alternatively, the extinguishing medium may be contained within a bladder, balloon, or container within the interior of the container. One or more bladders 701, as shown in FIG. 7, may be flexible containers constructed of rubber, plastic; polyvinyl chloride, etc. The bladders 701 may explode, rupture, and/or melt the vessel itself at a predetermined temperature or may incorporate nozzles 702 that may release fire extinguishing agent via heat sensitive plugs incorporated into their construction. In either case, the extinguishing agent may be directly delivered to the source of the fire within the FSCEA. Additionally, the extinguishing medium may be supplied via an externally mounted hose incorporating a universal adapter at one end for random extinguisher hook-ups and a fitting at the other end of the hose affixed to the apparatus with direct access to the inside of the FSCEA container which has the capability of being opened or closed when this extinguishing system is not being utilized. It also may also incorporate a normally sealed access hole or closable fitting attached to the container not incorporating a hose that has direct access to the interior of the container. A combination of any of these methods may be used as well.

Figure 5:
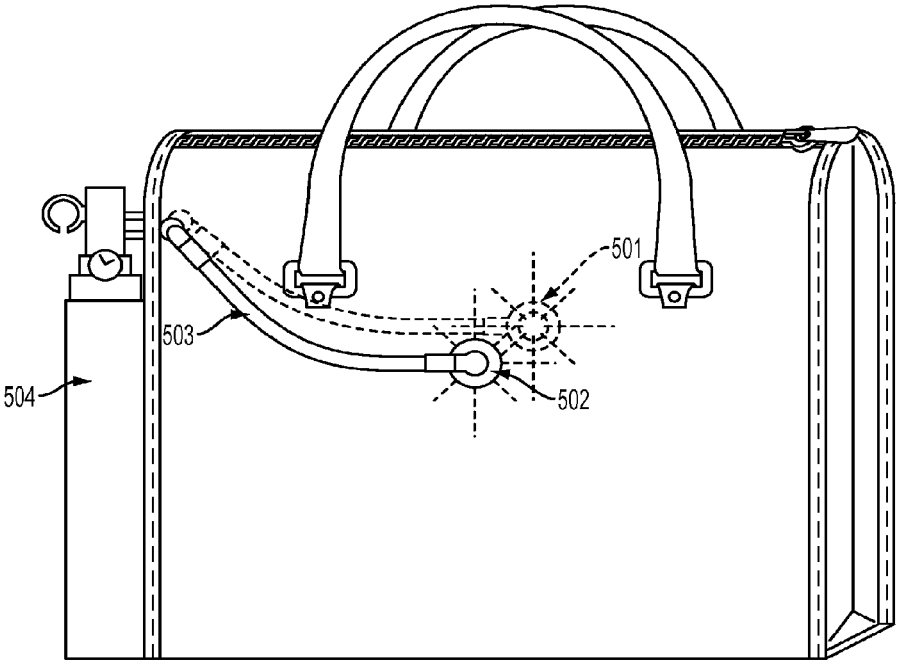
FIG. 5 is a perspective view of a fire and smoke containment and extinguishing bag with extinguisher according to one embodiment.

As shown in FIG. 5, flexible lines may deliver an extinguishing agent. One or more spray nozzles 501 may be positioned and/or attached inside a container. One or more fittings 502 may attach to and/or be in fluid communication with the one or more spray nozzles 501 to one or more fire resistant feed hoses 503. One or more extinguishers 504 may be in fluid communication with the one or more fire resistant feed hoses 503.

Figure 6:
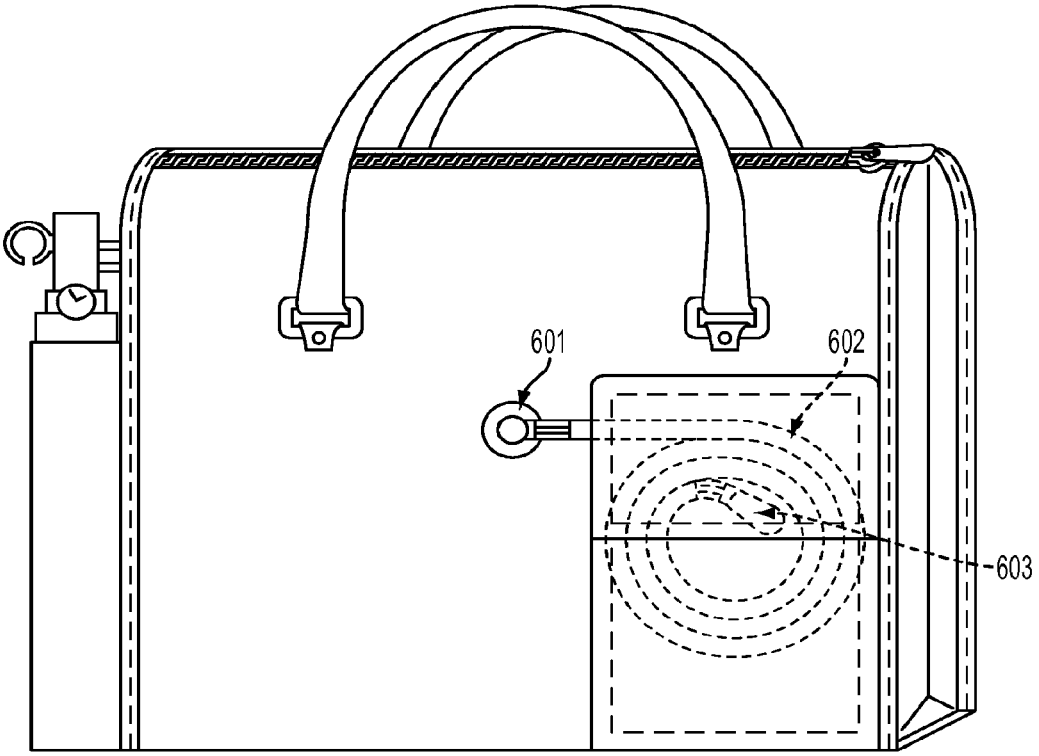
FIG. 6 is a perspective view of a fire and smoke containment and extinguishing bag with extinguisher according to one embodiment.

As shown in FIG. 6, one or more closeable or normally sealed access holes or fittings 601 may be in communication with one or more nozzles (not shown) inside a container. The holes or fittings 601 may be in fluid communication with a length of fire resistant hose 602. A fitting 603, such as a universal fitting, may be coupled to the hose 602, such as at a distal end. The fitting 603 may couple to a fire extinguisher or other source of extinguishing agent.

Airlines often operate in reduced pressure environments. The FSCEA may also be used in environments with access to reduced pressure lines. In some embodiments, especially those using a flexible container, the aforementioned hose/tube/access hole or an additional such hose/tube/access hole can be briefly connected to such reduced pressure environment to remove some or all of the atmosphere in the container to avoid providing oxygen to the item producing smoke or fire and to vent said smoke or fire from the living organism occupied environment.

An FSCEA container including an externally mounted extinguishing cylinder charged with pre-selected extinguishing agent may deliver the medium to the inside perimeter of the vessel or entire bag via direct application, supply lines, a hose that ruptures at a specified temperature or a combination of any of these methods.

The FSCEA container including an internal bladder or container may contain the extinguishing agent within the vessel itself. The bladder, bag, hose, line, etc. containing the extinguishing medium may automatically rupture, burst or melt to deliver the agent directly to the source of the fire, or the medium may be added manually to the bladder, bag, hose, line, etc. with a manual valve.

The FSCEA container including an externally mounted hose, tube, or normally sealed access hole may provide a direct means of delivering whatever extinguishing agent the user has chosen from another separate source to the interior of the vessel while ensuring the vessel remains completely sealed.

The externally mounted cylinder or internally mounted bladder type extinguisher may be designed to be deployed manually, automatically or a combination of both methods. The extinguishing agent may deploy automatically based on temperature sensors, temperature sensitive delivery lines, a bladder or bag that may melt, rupture, or burst at a predetermined temperature, etc. Manual deployment may be selected electrically, by removing a pin, by actuating a lever, physically puncturing a fire extinguisher agent container, etc. or a combination of any of these methods. Utilizing any of these methods may disperse the extinguishing agent directly within the FSCEA vessel, ultimately attacking and extinguishing the main source of the fire.

The FSCEA container utilizing an external or internally mounted extinguishing system and/or externally mounted delivery hose, line or access hole may then filter any resultant fumes and/or smoke that occur in an over-heat or fire condition. The smoke and fumes may be reduced by a filtering material incorporated into the construction of the vessel.

A safety equipment kit may be included with all FSCEA apparatus, and shall be designed for quick-access by the user.

Figure 8:
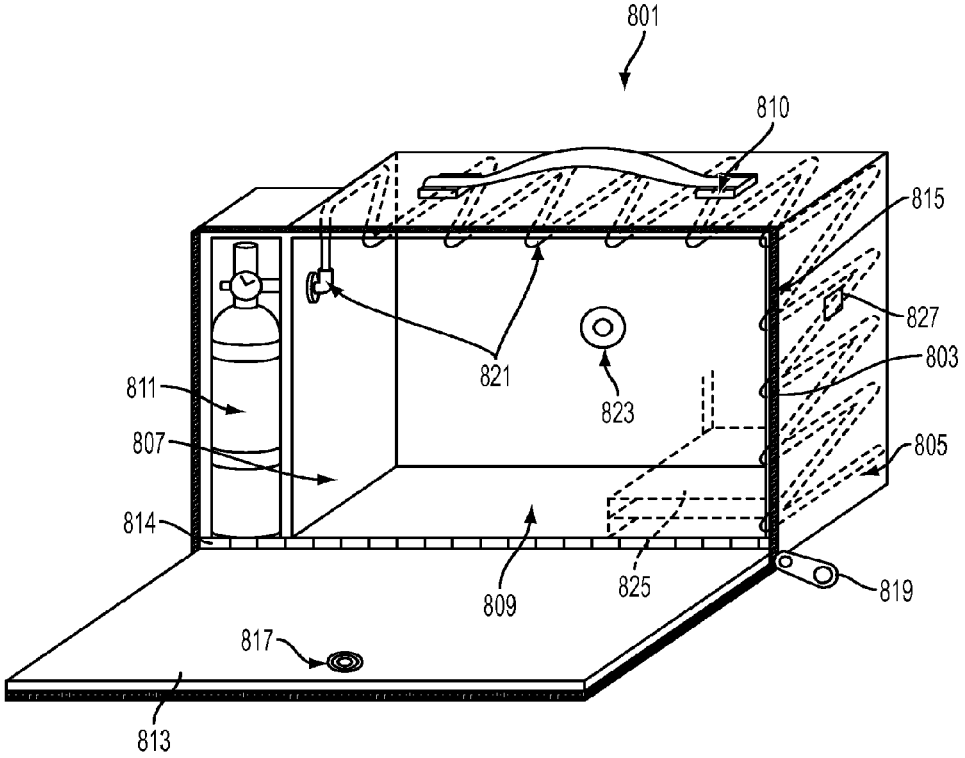
FIG. 8 is a perspective view of a fire and smoke containment and extinguishing shipping container according to one embodiment.

FIG. 8 is a perspective view of a fire and smoke containment and extinguishing shipping container 801 according to one embodiment. The shipping container 801 may be similar in composition and structure to one or more of the Fire and Smoke Containment and Extinguishing Apparatus (FSCEA) embodiments described herein. A primary use for the shipping container 801 would be to safely transport items within the shipping container 801 that are considered to pose a fire hazard. The shipping container 801 may contain and extinguish or greatly diminish a fire within the container 801. It may also greatly reduce the amount of smoke and toxic fumes experienced. In certain embodiments, five of six sides of the container 801 may be permanently sealed together and/or fixed in place. Other numbers of sides and configurations may be possible for different embodiments. For example, a spherical, conical, pyramidal, etc. container may be used. A container frame 803 may be constructed from metal, composite, or other fire resistant material. The container frame 803 may have one or more layers of material. An outer container 805 may be made of silicone covered fiberglass, vinyl laminated polyester, NOMEX fabric, etc. An inner box 807, which may define a recess 809 within the container for storing items, may incorporate a ceramic fiber material or other material. A handle 810 may be incorporated to easily and safely move the shipping container 801. The item to be transported may be placed inside the container 801. An extinguishing suppression system 811 may include one or more extinguishers or other fire suppression system. The extinguishing suppression system 811 may be armed and a vessel access door 813 may be completely closed and sealed to active the container during shipping. The access door 813 may rotate around a hinge 814. A fire resistant gasket 815 made from a coated fiberglass, ceramic fiber, graphite etc., may seal the internal recess 809 of the container 801. A latch assembly 817 may lock the sixth side in place, and a zipper 819 or other closure such as hook and loop fasteners, snaps, etc., may ensure a fire proof seal. The extinguishing medium delivery system 821 may vary between embodiments, but may include a fire detection tubing, fire resistant hoses, thermal release valves, etc. The container 801 may also utilize a smoke filtering vent system 823 to relieve internal pressures within the container 801.

The container may be used alone or may be placed within a larger shipping container. The container may be placed for transportation into a non-volatile area of the aircraft, ship, delivery vehicle, etc. The internal vessel 808 of the container 801 may be divided by one or more removable fire-resistant bulkheads 825. The bulkheads may be placed within the recess 809 and/or may interact into grooves or other attachment/guide devices. This may allow multiple items to be transported within the same container with a firewall separation between sections. This may also allow different extinguishing mediums to be utilized based on the needs of each item.

A temperature sensor 827 may be physically installed on the container 801 as way to directly monitor the actual temperatures inside of the container. The container may incorporate a means to physically connect to the transportation vehicle, aircraft, boat, etc. to directly monitor conditions inside the container.

Dependent upon the specific applications, the FSCEA apparatus kit could include safety equipment which may include but not limited to a pair of fire resistant gloves, a face shield with or without breathing apparatus, a smoke hood, a fire resistant apron and various other personal protective devices and/or tools that may be utilized to position the hot item within the vessel.

The FSCEA apparatus can be made into a variety of sizes from small to large dependent upon the specific application. Smaller containers may hold a single small electronic device and larger sizes may be used as well for other purposes and to contain larger objects and/or multiple objects. It may be constructed as a soft-sided vessel (bag), a rigid-sided box like container, or a combination of both. The container may be constructed of different layers of fire resistant materials including but not limited to metals, fire resistant composites, treated fiberglass, silicon and/or silicon impregnated fabric, vermiculite, NOMEX, KEVLAR, ceramic cloth, treated vegetable fiber, polybenzimidazole (PBI) fiber, wool, PYROVATEX FR cotton, treated carbon fiber, halo generated hydrocarbons, antimony oxides, phosphate based compounds, vinyl laminated polyester or NYLON. Some materials are inherently nonflammable while others may require treatment with fire inhibiting compounds. Materials not requiring treatment include most polyesters, modacrylic (VEREL, SEF, KANECARON); matrix (CORDELAN); and vinyon (LEAVIL). "Inherently" flame resistant polyester textiles may be manufactured with built-in fire retardants. This is because the fire retardants can be chemically inserted into the polyester compound, becoming a part of its molecular composition. The enhanced polymers are quite stable, so such polyester materials are unlikely to pose a health risk, beyond the reduced breathability of the fabric.

The material selected to make the bag may vary depending on the objectives of the bag. The extinguisher may discharge automatically, thermally, manually or electronically. The bag may incorporate the fire detection and delivering hose to spray the extinguishing agent, a hard mounted line and/or a flexible line to deliver the extinguishing agent within the bag. In lieu of an extinguisher or in addition to the extinguisher an external hose or access hole could be incorporated into the bag to provide additional extinguishing agent into the bag. The extinguishing agents could vary from a gas, liquid, dry chemical, gel, water, dry chemical, clean agent, wet chemical, etc. based on its purpose. Embodiments of the present invention may be used for any item which is on fire or in danger of catching fire which needs to be relocated, confined, extinguished and shielded from other items. The bag could be used in transportation of hazardous or flammable items, as a shipping container used to safely transport items which have the potential to catch on fire. It could also be a tool incorporated by the military, fire departments, personal use, etc.

Embodiments of the present invention may include a method of using the FSCEA apparatus. In certain embodiments, an individual using the apparatus may determine if an item or device is overheating, and/or is in danger of or has already caught on fire.

In the case of an over-heat or fire condition, the individual may immediately secure the FSCEA apparatus, and don the necessary safety equipment provided within the quick-access safety equipment kit. Items donned first may likely include the fire resistant gloves and may vary according to application.

After donning the appropriate safety equipment, the user may then transfer the item into the containment vessel. It may be necessary to first apply other available extinguishing methods prior to relocating the item within the FSCEA vessel if the user deems it to be the safest practice. The vessel may then be completely sealed. The vessel seal may include a fire-resistant zipper, straps, snaps, hook and loop closures, or other closures.

After the item has been safely transferred and sealed inside of the FSCEA apparatus, dependent upon the specific FSCEA application type, the user may perform one or more of the following:

Allow the FSCEA system to deploy extinguishing agent within the vessel automatically;

Arm the FSCEA system by pulling an arming pin, or other arming method and allowing the extinguishing agent within the vessel to automatically deploy;

Manually deploy the extinguishing agent within the FSCEA vessel; or

Connect a separate alternative extinguishing source to the provided access hole or hose and deploy.

Provided that the FSCEA vessel has been properly sealed, this may effectively contain any flames and heat, as well as contain and filter any resultant fumes or smoke created by the fire or overheat condition.

The list of items with a potential to overheat or catch on fire is endless, and includes but is not limited to all types of batteries, personal computers, personal electronic devices, cell phones, computer tablets, home electronics, any electrical device, any plug in items such as air fresheners, kitchen appliances and pans, etc.

Embodiments of the FSCEA may be used in a wide range of areas and may lower the possibility of a catastrophic loss of equipment, property, processions and lives by providing a reduction of the amount of fumes and smoke experienced in a fire, extinguish and/or relocate a fire or potential fire to a more suitable and safer location.

In general, the FSCEA apparatus may limit collateral damage to surrounding areas that may be experienced with current extinguishing methods, and/or to provide a method for safely and effectively extinguishing a fire when other methods may not exist.

The FSCEA apparatus may contain the fire within the vessel and fully extinguish or greatly reduce the fire within. It may also greatly reduce or eliminate the amount of smoke and toxic fumes emitted (which is vital to confined spaces where there is limited access to breathable air is available, such as pressurized aircraft).

The FSCEA apparatus may also provide a means of safely transporting an item which may pose a threat during transportation. FSCEA apparatus application may be varied by simply changing the extinguishing medium and/or the apparatus size to meet the needs of each specific consumer application.

The FSCEA apparatus may be adapted and utilized as an effective tool for any individual user and can be modified for entities such as professional fire departments, the aviation and travel industries, restaurants and kitchens, lodging, tourism, transportation, naval, shipping and cruise ships, businesses, military applications, or by any other entity or individual who may be inclined purchase a means to protect lives, property and possessions from the possible threat of fire.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

What is claimed is:

1. A fire and smoke containment and extinguishing apparatus comprising:

a container permanently sealed on all sides except one side, said except one side forming an access door, said access door being reversibly sealable on all edges except one edge, said access door being permanently integral to an edge of at least one of said permanently sealed sides via said except one edge, and said access door reversibly sealed to at least one of said permanently sealed sides, said container comprising an inner recess defined by said permanently sealed sides and said except one side, said inner recess is of a size to receive through said access door a battery operated device producing fire, smoke, toxic fumes, or combinations thereof, said inner recess substantially prevents fire, smoke and fumes inside said inner recess from passing outside said container;

one or more fire extinguishing systems in communication with said container for extinguishing and preventing fire within said inner recess; and one or more removable fire-resistant bulkheads within said inner recess.

2. The apparatus of claim 1, wherein said one or more fire extinguishing systems is coupled to said at least one of said permanently sealed sides defining said inner recess.

3. The apparatus of claim 1, wherein said one or more fire extinguishing systems is a self-contained fire extinguishing cylinder.

4. The apparatus of claim 3, wherein a fire extinguishing system outlet is in communication with said inner recess via an inlet, and wherein said inlet is in communication with a sense line or fire or heat detection tubing within said inner recess.

5. The apparatus of claim 1, wherein said one or more fire extinguishing systems comprises one or more hoses located within said inner recess.

6. The apparatus of claim 1, wherein said one or more fire extinguishing systems is an extinguishing medium contained within a bladder or bag within said inner recess.

7. The apparatus of claim 1, wherein said one or more fire extinguishing systems is an extinguishing medium supplied via an externally mounted hose, tube or normally sealed access hole with direct access to said inner recess.

8. The apparatus of claim 1, wherein said one or more fire extinguishing systems deploys at a predetermined temperature.

9. The apparatus of claim 1, further comprising one or more sense lines or fire or heat detection tubing within said inner recess, wherein said one or more sense lines or fire or heat detection tubing are configured to rupture at a predetermined temperature.

10. The apparatus of claim 1, wherein said fire extinguishing system is automatically deployable based on temperature sensors, temperature sensitive delivery lines, a bladder or bag that may melt, rupture, or burst at a predetermined temperature, and combinations thereof.

11. The apparatus of claim 1, wherein said one or more fire extinguishing systems is manually deployable based on electrical selection, removal of a pin, actuation of a lever, physical puncturing of a fire extinguisher agent container, and combinations thereof.

12. The apparatus of claim 1, further comprising a temperature sensor for monitoring actual temperatures within the container.

13. The apparatus of claim 1, wherein said removable fire-resistant bulkheads comprise at least one layer of fire resistant materials, wherein at least one layer is a special fiberglass cloth rated at 1000° F. or higher, or a ceramic fiber material rated at 2300° F. or higher, or combinations thereof.

14. The apparatus of claim 13, wherein the ceramic fiber material is a filtering layer for smoke and fumes.

* * * * *